US012703549B2

(12) United States Patent
Noveletsky

(10) Patent No.: US 12,703,549 B2
(45) **Date of Patent: *Aug. 11, 2026**

(54) CONTAINER LID WITH ROTATABLE SIPPER AND FLEXIBLE HANDLE

(71) Applicant: Cool Gear International, LLC, Plymouth, MA (US)

(72) Inventor: Tyler Noveletsky, North Easton, MA (US)

(73) Assignee: Cool Gear International, LLC, Plymouth, MA (US)

( * ) Notice: Subject to any disclaimer, the term of this patent is extended or adjusted under 35 U.S.C. 154(b) by 86 days.

This patent is subject to a terminal disclaimer.

(21) Appl. No.: 18/317,535

(22) Filed: May 15, 2023

(65) Prior Publication Data

US 2023/0278759 A1 Sep. 7, 2023

Related U.S. Application Data

(63) Continuation of application No. 16/722,154, filed on Dec. 20, 2019, now Pat. No. 11,673,720.
(Continued)

(51) Int. Cl.
*B65D 47/20* (2006.01)
*B65D 25/28* (2006.01)
(Continued)

(52) U.S. Cl.
CPC ..... *B65D 47/2006* (2013.01); *B65D 25/2852* (2013.01); *B65D 43/0231* (2013.01);
(Continued)

(58) Field of Classification Search
CPC ..... B65D 47/2006; B65D 25/2852; B65D 43/0231; B65D 47/065; B65D 47/066;
(Continued)

(56) References Cited

U.S. PATENT DOCUMENTS 4,213,310 A 7/1980 Buss
D262,856 S 2/1982 Mactavish
(Continued)

FOREIGN PATENT DOCUMENTS

AU 2004100578 9/2004
AU 2004201562 10/2005
(Continued)

OTHER PUBLICATIONS

U.S. Appl. No. 16/722,154 titled "Container Lid With Rotatable Sipper and Flexible Handle" filed Dec. 20, 2019.
(Continued)

*Primary Examiner* — Don M Anderson
*Assistant Examiner* — John Martin Hoppmann
(74) *Attorney, Agent, or Firm* — Dinsmore & Shohl LLP

(57) ABSTRACT

A container lid can include: a body having an opening formed therethrough; a sipping member rotatably coupled to the body, a passageway formed through an interior of the sipping member so as to extend from a proximal end of the sipping member to a distal end of the sipping member, the sipping member configured to rotate between a stowed position in which the passageway and the opening are misaligned, such that the opening is sealed, and a released position in which the passageway and the opening are aligned; and a flexible handle connected at a first end to the sipping member and rotatably coupled at a second end to the body via a pivot pin. The handle can be configured such that a substantially downward force exerted on the handle causes rotation of the sipping member toward the released position.

14 Claims, 4 Drawing Sheets

Related U.S. Application Data

(60) Provisional application No. 62/787,894, filed on Jan. 3, 2019.

(51) Int. Cl.
*B65D 43/02* (2006.01)
*B65D 47/06* (2006.01)

(52) U.S. Cl.
CPC ..... *B65D 47/065* (2013.01); *B65D 47/066* (2013.01); *B65D 2525/282* (2013.01)

(58) Field of Classification Search
CPC ..... B65D 2525/282; B65D 47/305; B65D 51/242; B65D 47/0866; B65D 43/26; A45F 3/16
USPC ..... 220/254.3, 282; 222/517, 469, 534, 536; 215/306, 301
See application file for complete search history.

(56) References Cited

U.S. PATENT DOCUMENTS

D268,469 S 4/1983 Ruxton et al.
D279,346 S 6/1985 Ruxton
D294,325 S 2/1988 Fiore, Jr.
4,756,442 A * 7/1988 Halm ..... B65D 47/0847 222/509
D338,130 S 8/1993 Costello
5,273,172 A 12/1993 Rossbach et al.
5,465,866 A 11/1995 Belcastro
5,735,438 A * 4/1998 Ostrowsky ..... B65D 47/0866 222/498
5,901,885 A * 5/1999 Iida ..... B65D 47/0866 222/565
5,964,365 A 10/1999 Peeples
6,164,484 A 12/2000 Fiore
6,276,560 B1 8/2001 Belcastro
6,279,773 B1 8/2001 Kiyota
6,494,056 B1 12/2002 Roth
6,523,711 B1 2/2003 Hughes et al.
6,584,800 B1 7/2003 Roth
D478,469 S 8/2003 Roth
6,601,403 B1 8/2003 Roth
D485,468 S 1/2004 Roth
D511,435 S 11/2005 Roth
D512,875 S 12/2005 Maldonado
D518,335 S 4/2006 Stuart
7,082,784 B2 8/2006 Roth
D549,048 S 8/2007 Duke
D624,361 S 9/2010 Roth
7,866,183 B2 1/2011 Roth
D634,158 S 3/2011 Roth
D634,161 S 3/2011 Roth
7,997,099 B2 8/2011 Roth
8,051,674 B2 11/2011 Roth
8,061,158 B2 11/2011 Roth
8,276,776 B2 10/2012 Roth
8,408,414 B2 4/2013 Roth
8,544,676 B2 10/2013 Roth
D696,906 S 1/2014 Roth
8,672,174 B1 3/2014 Mcmullin
8,777,039 B2 7/2014 Roth
RE45,055 E 8/2014 Roth
D738,163 S 9/2015 Roth
9,380,898 B2 7/2016 Mason
9,573,738 B1 2/2017 Lai
D804,903 S 12/2017 Mason
D804,904 S 12/2017 Noveletsky
9,944,438 B2 4/2018 Roth
10,077,143 B2 9/2018 Roth
10,196,182 B2 2/2019 Roth
D874,217 S 2/2020 Tsai
2002/0040909 A1 4/2002 Goto et al.
2003/0196448 A1 10/2003 Roth
2005/0092781 A1* 5/2005 Delage ..... B65D 50/045 222/498
2005/0258201 A1 11/2005 Willows
2006/0185384 A1 8/2006 Roth
2008/0078200 A1 4/2008 Roth
2008/0078787 A1 4/2008 Yelland
2008/0217284 A1 9/2008 Roth
2008/0277020 A1* 11/2008 Windmiller ..... B67D 1/0805 220/756
2010/0193462 A1 8/2010 Roth
2011/0198361 A1 8/2011 Chen
2012/0160881 A1* 6/2012 Pourian ..... B65D 47/0861 222/498
2012/0181277 A1 7/2012 Wang-Wu et al.
2012/0234789 A1 9/2012 Mason
2012/0285961 A1 11/2012 Roth
2013/0214006 A1 8/2013 Roth
2015/0307265 A1 10/2015 Winn
2016/0001933 A1 1/2016 Roth
2016/0120343 A1 5/2016 Liang
2016/0296051 A1 10/2016 Lane et al.
2017/0015462 A1 1/2017 Roth
2017/0050775 A1 2/2017 Sanbar
2017/0050785 A1 2/2017 Roth
2017/0144809 A1 5/2017 Sorensen et al.
2017/0340148 A1 11/2017 Chen et al.
2018/0050850 A1 2/2018 Murosky et al.
2019/0135502 A1 5/2019 Tsai
2020/0055646 A1 2/2020 DeKeyser
2020/0148431 A1 5/2020 Tsai
2020/0216218 A1 7/2020 Sanbar
2020/0216232 A1 7/2020 Noveletsky
2020/0367678 A1 11/2020 Harris

FOREIGN PATENT DOCUMENTS

AU 328776 12/2009
AU 2010200265 8/2010
AU 2011332161 5/2013
AU 2016201471 4/2016
AU 2014368954 6/2016
AU 2015218686 9/2016
AU 1491016 11/2016
AU 1491116 11/2016
AU 1644816 11/2016
AU 1644916 11/2016
AU 2015259105 11/2016
AU 2015259182 11/2016
AU 2015259183 11/2016
AU 2017204758 7/2017
AU 2017226173 9/2018
AU 2017226178 9/2018
AU 2017354038 5/2019
AU 2018309062 2/2020
AU 2019376154 3/2021
CA 51305 5/1983
CA 2292400 6/2000
CA 2470906 6/2005
CA 132268 6/2010
CA 135424 6/2010
CA 135425 6/2010
CA 2691193 8/2010
CA 2817042 5/2012
CA 2900674 9/2014
CA 2933614 6/2015
CA 2939634 8/2015
CA 2948174 11/2015
CA 2948176 11/2015
CA 2948180 11/2015
CA 3016564 9/2017
CA 3042043 5/2018
CA 170355 9/2018
CA 170356 9/2018
CA 178839 9/2018
CA 178861 9/2018
CA 172791 1/2019
CA 3070466 2/2019
CA 3112845 5/2020
CN 101798009 8/2010

(56) References Cited

FOREIGN PATENT DOCUMENTS

| | | | |
|---|---|---|---|
| CN | 201770189 | | 3/2011 |
| CN | 1013129824 | A | 6/2013 |
| CN | 106170444 | | 11/2016 |
| CN | 106414265 | | 2/2017 |
| CN | 106458385 | | 2/2017 |
| CN | 106660672 | | 5/2017 |
| CN | 207803967 | | 9/2018 |
| CN | 109068879 | | 12/2018 |
| CN | 109071073 | | 12/2018 |
| CN | 109744820 | | 5/2019 |
| CN | 110997512 | | 4/2020 |
| CN | 112996411 | | 6/2021 |
| DK | 2958818 | | 10/2017 |
| EP | 2958818 | | 12/2015 |
| EP | 3107814 | | 12/2016 |
| EP | 3142941 | | 3/2017 |
| EP | 2958818 | B1 | 7/2017 |
| EP | 3142939 | | 11/2017 |
| EP | 3142940 | | 12/2017 |
| EP | 3257778 | | 12/2017 |
| EP | 3083443 | | 6/2018 |
| EP | 3534757 | | 9/2019 |
| EP | 3423372 | | 3/2020 |
| EP | 3661853 | | 6/2020 |
| EP | 3876785 | | 9/2021 |
| ES | 2642832 | | 11/2017 |
| GB | 2442593 | | 2/2009 |
| GB | 2467629 | | 8/2010 |
| GB | 2477219 | | 7/2011 |
| GB | 2475189 | | 9/2011 |
| GB | 2482766 | | 2/2012 |
| GB | 2493790 | A | 2/2013 |
| GB | 2528619 | | 1/2016 |
| HK | 1157301 | | 11/2012 |
| HK | 1167376 | | 3/2013 |
| HR | P20171530 | | 2/2018 |
| JP | H04294751 | A | 10/1992 |
| JP | 2003312706 | | 11/2003 |
| JP | 2008120456 | | 5/2008 |
| JP | 2014500835 | | 1/2014 |
| JP | 2017504532 | | 2/2017 |
| JP | 2017509555 | | 4/2017 |
| JP | 2017518928 | | 7/2017 |
| JP | 2017518929 | | 7/2017 |
| JP | 2017520483 | | 7/2017 |
| JP | 2019506983 | | 3/2019 |
| JP | 2019507710 | | 3/2019 |
| KR | 1020030064663 | | 8/2003 |
| KR | 1020160102033 | | 8/2016 |
| KR | 1020170007389 | | 1/2017 |
| KR | 1020170007393 | | 1/2017 |
| KR | 1020170009900 | | 1/2017 |
| KR | 1020180107285 | | 10/2018 |
| KR | 1020180116426 | | 10/2018 |
| KR | 1020200027572 | | 3/2020 |
| KR | 1020210089660 | | 7/2021 |
| MX | PA03001327 | | 7/2005 |
| MX | 2016008030 | | 10/2016 |
| MX | 2016014799 | | 3/2017 |
| MX | 2016014803 | | 3/2017 |
| MX | 2016014804 | | 3/2017 |
| MX | 2018010638 | | 5/2019 |
| MX | 2018010641 | | 6/2019 |
| PL | 2958818 | | 3/2018 |
| SI | 2958818 | | 12/2017 |
| WO | WO2008112504 | | 9/2008 |
| WO | WO2009010087 | | 1/2009 |
| WO | WO2012071218 | | 5/2012 |
| WO | WO2013096809 | | 6/2013 |
| WO | WO2014137582 | | 9/2014 |
| WO | WO2015095776 | | 6/2015 |
| WO | WO2015127373 | | 8/2015 |
| WO | WO2015175689 | | 11/2015 |
| WO | WO2015175716 | | 11/2015 |
| WO | WO2015175717 | | 11/2015 |
| WO | WO2015175723 | | 11/2015 |
| WO | WO2017146625 | | 8/2017 |
| WO | WO2017152016 | | 9/2017 |
| WO | WO2017152021 | | 9/2017 |
| WO | WO2018085412 | | 5/2018 |
| WO | WO2019028326 | | 2/2019 |
| WO | WO2020097501 | | 5/2020 |
| WO | WO2020142252 | | 7/2020 |

OTHER PUBLICATIONS

Non-Final Office Action issued in U.S. Appl. No. 16/722,154 mailed on Dec. 14, 2021.

Final Office Action issued in U.S. Appl. No. 16/722,154 mailed on Jun. 2, 2022.

Notice of Allowance issued in U.S. Appl. No. 16/722,154 mailed on Feb. 3, 2023.

Corrected Notice of Allowability issued in U.S. Appl. No. 16/722,154 mailed on Mar. 22, 2023.

Corrected Notice of Allowability issued in U.S. Appl. No. 16/722,154 mailed on Feb. 28, 2023.

International Search Report and Written Opinion issued in PCT Patent Application No. PCT/US2019/067742 mailed on Mar. 19, 2020.

U.S. Appl. No. 62/787,894, filed Dec. 20, 2019 titled Container Lid With Rotatable Sipper and Flexible Handle.

Office Action issued in Chinese Patent Application No. 201980086850.9 mailed on Dec. 13, 2022.

Office Action issued in Chinese Patent Application No. 201980086850.9 mailed on Apr. 28, 2022, 17 pages including English translation.

U.S. Appl. No. 62/787,894 titled "Container Lid With Rotatable Sipper and Flexible Handle" filed Jan. 3, 2019.

PCT Patent Application No. PCT/US2019/067742 titled "Container Lid With Rotatable Sipper and Flexible Handle" filed Dec. 20, 2019.

International Preliminary Report on Patentability issued in PCT Patent Application No. PCT/US2019/067742 mailed on Jul. 15, 2021.

Mexican Patent Application No. MX/a/2021/008077 titled "Container Lid With Rotatable Sipper and Flexible Handle" filed on Jan. 7, 2021.

Korean Patent Application No. 10-2021-7020884 titled "Container Lid With Rotatable Sipper and Flexible Handle" filed on Aug. 3, 2021.

Japanese Patent Application No. 2021-539133 titled "Container Lid With Rotatable Sipper and Flexible Handle" filed on Jul. 5, 2021.

European Patent Application No. 19907503.7 titled "Container Lid With Rotatable Sipper and Flexible Handle" filed on Aug. 3, 2021.

Extended European Search Report issued in European Patent Application No. 19907503.7 mailed on Oct. 5, 2022.

Chinese Patent Application No. 201980086850.9 titled "Container Lid With Rotatable Sipper and Flexible Handle" filed on Jun. 28, 2021.

Canada Patent Application No. 3122313 titled "Container Lid With Rotatable Sipper and Flexible Handle" filed on Jun. 4, 2021.

Australia Patent Application No. 2019418426 titled "Container Lid With Rotatable Sipper and Flexible Handle" filed on Jun. 1, 2021.

* cited by examiner

CONTAINER LID WITH ROTATABLE SIPPER AND FLEXIBLE HANDLE

CROSS-REFERENCE TO RELATED APPLICATIONS

This continuation patent application claims priority to and benefit of, under 35 U.S.C. § 120, U.S. patent application Ser. No. 16/722,154, titled "Container Lid With Rotatable Sipper And Flexible Handle," filed Dec. 20, 2019, which claims priority to U.S. Provisional Patent Application No. 62/787,894, titled "Container Lid With Rotatable Sipper And Flexible Handle," filed Jan. 3, 2019, the entirety of which is incorporated by reference herein.

TECHNICAL FIELD

The present disclosure relates generally to container lids, and more particularly, to a container lid with a rotatable sipper and flexible handle.

BACKGROUND

Container lids can include mechanisms, such as caps (e.g., a screw-on cap, a flip cap, a push cap, etc.), for sealing an opening of a container through which fluid may enter and/or exit. To access fluid within the container while the container lid engages the container, a user can typically move or remove the cap relative to the opening of the container such that a fluid path into the container may be provided, allowing the user to drink through the lid. When the user wishes to seal the container (e.g., for transport), the user can move the cap such that the fluid path is sealed. Ideally, the cap seals the fluid path in a leak-proof manner so that leakage of fluid within the container is prevented.

A wide range of container lid designs exist. Some designs include a sipping member, or "sipper," which operates akin to a straw through which a user can drink fluid contained inside of the container. Other designs include a handle protruding from the lid to enable the container to be carried when the lid and container are coupled together. However, there is a need for a container lid which incorporates both a sipping member and a handle to achieve an enhanced degree of usability, portability, and convenience.

SUMMARY

The present disclosure provides a container lid with a rotating sipping member coupled to a flexible handle for convenient transport of the lid and container. When the sipping member is stowed away, a user can carry the container, coupled to the lid, by the handle without the sipping member releasing. Upon exerting a substantially downward force (e.g., push, pull, etc.) on the handle, the sipping member can release and rotate to a released position.

According to embodiments of the present disclosure, a container lid can include: a body having an opening formed therethrough and a thread pattern formed thereon for reversibly mating the container lid to a container, the opening in fluid communication with an interior of the container; a sipping member rotatably coupled to the body, a passageway formed through an interior of the sipping member so as to extend from a proximal end of the sipping member to a distal end of the sipping member, the sipping member configured to rotate between a stowed position in which the passageway and the opening are misaligned, such that the opening is sealed, and a released position in which the passageway and the opening are aligned; and a flexible handle connected at a first end to the sipping member and rotatably coupled at a second end to the body via a pivot pin. The handle can be configured such that a substantially downward force exerted on the handle causes rotation of the sipping member toward the released position.

The handle can be configured such that, when the sipping member is in the stowed position, the sipping member remains in the stowed position in response to a substantially upward or lateral force exerted on the handle.

When the sipping member is in the released position, the passageway of the sipping member and the opening can define a fluid path through which a fluid disposed in the interior of the container can exit the container. When the sipping member is in the stowed position, the fluid path defined by the passageway of the sipping member and the opening can be obstructed.

When the sipping member is in the stowed position, the opening can be sealed by a portion of a body of the sipping member.

The handle can be configured such that the downward force exerted on the handle further causes rotation of the handle about the pivot pin.

Rotation of the sipping member from the stowed position to the released position can cause the handle to rotate about the pivot pin approximately 90 degrees.

Rotation of the sipping member from the released position to the stowed position can increase a size of a carrying space defined by the handle and an outer portion of the body.

When the sipping member is in the released position, at least one of a portion of the sipping member and a portion of the handle can be configured to come into contact with an outer surface of the body, preventing further rotation of the sipping member away from the stowed position.

The first end of the handle can be co-injected with a portion of the sipping member.

The first end of the handle can include a protrusion portion having a surface level raised above that of an adjacent portion of the handle.

An upper surface of the protrusion portion can be surrounded entirely by a portion of the sipping member.

The first end of the handle can be positioned above the second end of the handle when the container lid is oriented in an upright manner.

The container lid can further include an indentation portion formed into the upper surface of the body, the indentation portion defining an interior receiving space configured to receive a portion of the sipping member. Additionally, the container lid can further include support arms extending outwardly from opposite sides of the sipping member, respectively, and disposed at least partially inside of the indentation portion. The sipping member can be rotatably coupled to the body via the support arms such that the sipping member is configured to rotate about the support arms. The support arms can be integral with the sipping member.

The indentation portion further can define support arm receiving spaces configured to receive the support arms. Also, when the sipping member is in the stowed position, the indentation portion is configured to receive the sipping member such that an upper surface of the sipping member is substantially flush with an upper surface of the body.

The thread pattern can be formed on an interior surface of the body.

The sipping member can be made of a polypropylene-based material, and the handle can be made of a silicon-based material or a thermoplastic rubber-based material.

BRIEF DESCRIPTION OF THE DRAWINGS

The embodiments herein may be better understood by referring to the following description in conjunction with the accompanying drawings in which like reference numerals indicate identically or functionally similar elements, of which.

Figure 1:
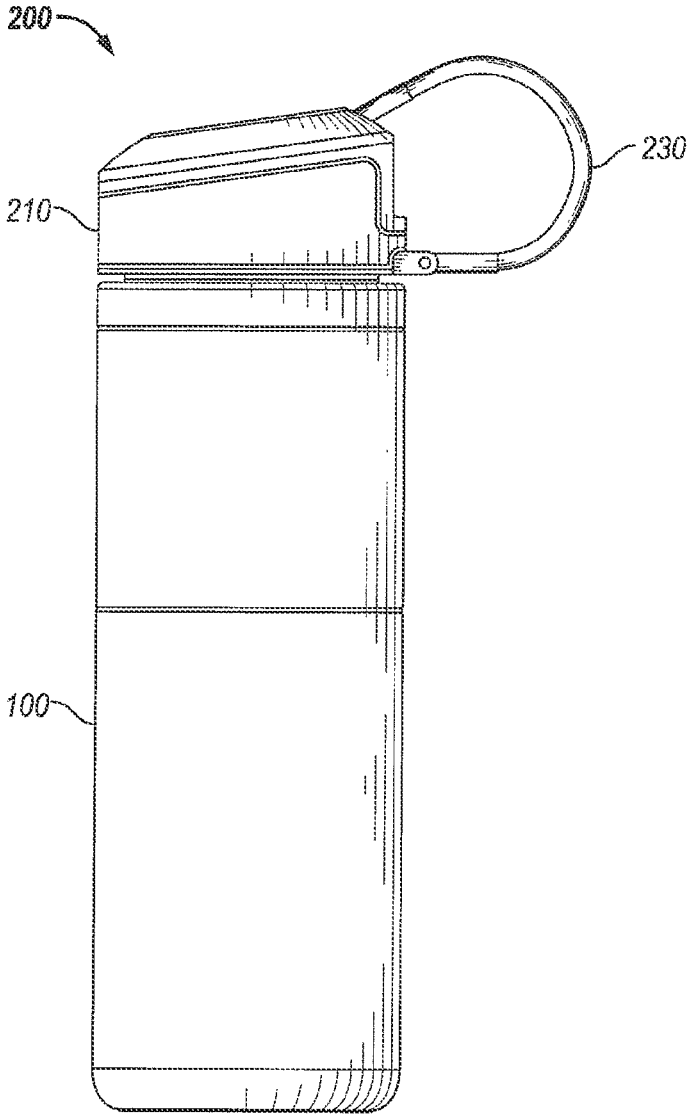
FIG. 1 is a side view of a container coupled to a lid with a rotatable sipping member in a stowed position.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Referring now to embodiments of the present disclosure, the disclosed container lid can include a sipping member, or "sipper," coupled to a flexible handle for convenient transport. The sipping member can rotate between a stowed position, in which the sipping member is stowed within an indentation portion formed in an upper surface of the lid, and a released position, in which a user can sip fluid contained inside of a container. While the sipping member is stowed, the user can carry the lid by handle, exerting a substantially upward force on the handle, and the sipping member can remain stowed. To release the sipping member, the user can downwardly push or pull the handle, thereby rotating the sipping member to a released position.

Figure 2A:
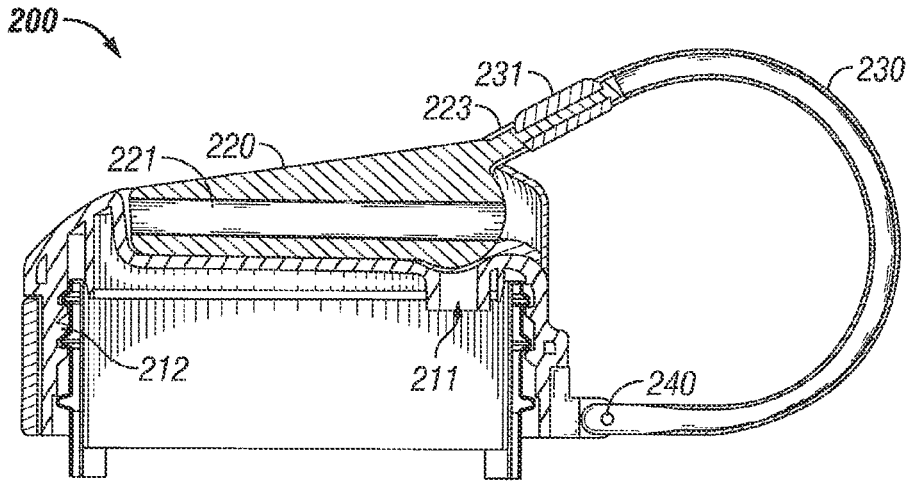
FIGS. 2A and 2B include a side cross-sectional view and a top view, respectively, of the lid of FIG. 1.
Figure 2B:
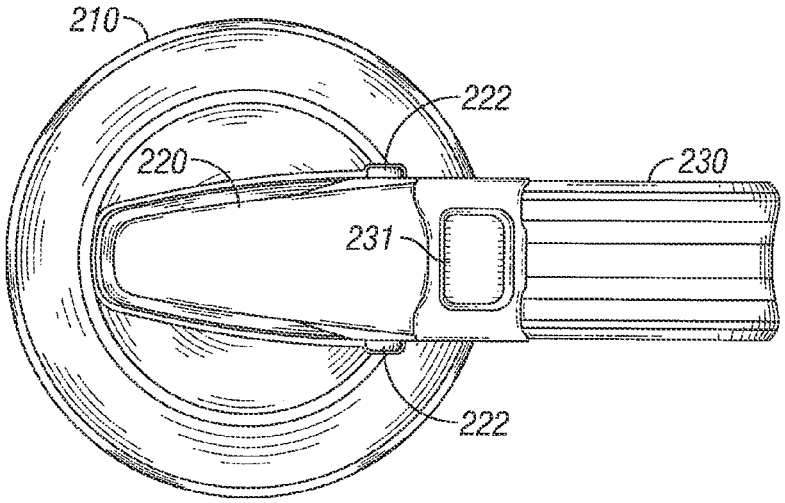
Figure 3:
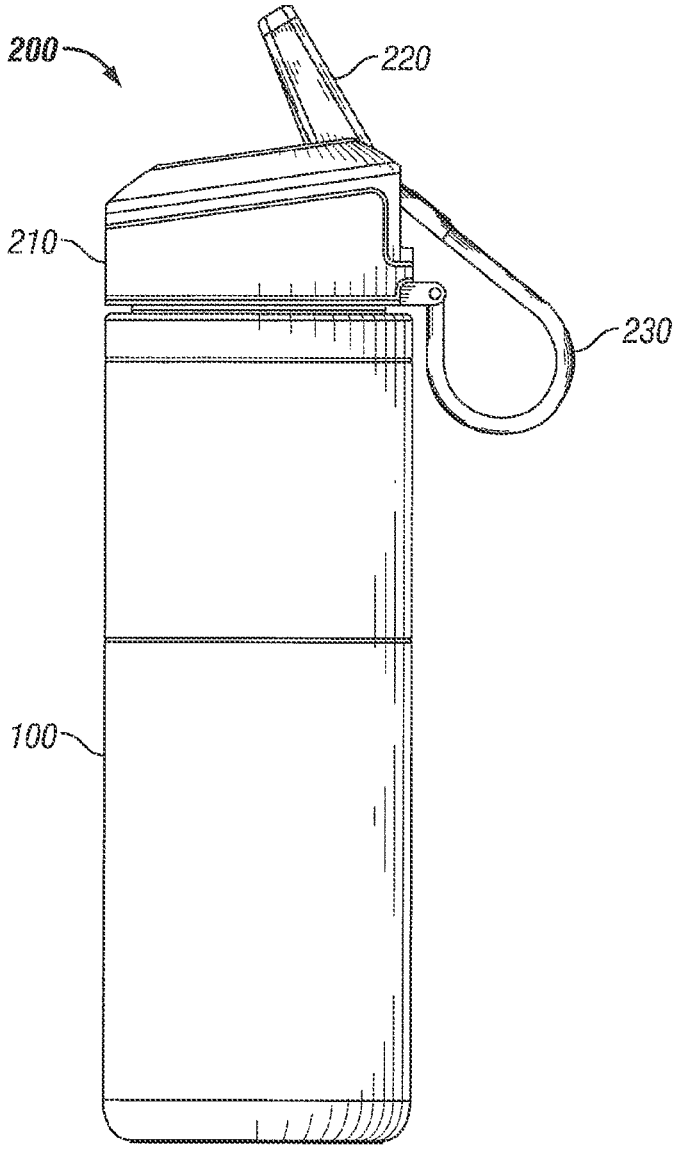
FIG. 3 is a side view of a container coupled to a lid with a rotatable sipping member in a released position.

FIG. 1 is a perspective view of a container 100 coupled to a lid 200 with a rotatable sipping member 220 in a stowed position, and FIGS. 2A and 2B include a side cross-sectional view and a top view, respectively, of the lid 200 with the rotatable sipping member 220 in the stowed position. FIG. 3 is a side view of the container 100 coupled to the lid 200 with the rotatable sipping member 220 in a released position, and FIGS. 4A and 4B include a side cross-sectional view and a front view, respectively, of the lid 200.

As shown in FIGS. 1 and 2A-2B, the lid 200 can reversibly couple to a container 100 operable to contain a fluid (e.g., liquid). The container 100 can include a base coupled to a plurality of upwardly extending walls forming an opening at an upper end of the container 100, as will be generally known in the art. The container 100 can be formed of various materials, including, for instance, metallic materials such as stainless steel, plastic-based materials, ceramic-based materials, or the like. The container 100 can include, for instance, a single- or double-walled structure. The container 100 can be shaped in any suitable manner, such as cylindrical as shown in FIG. 1.

The lid 200 can couple to the upper end of the container 100, covering the opening of the container 100. The lid 200 can include a body 210. The body 210 can be formed of various materials, such as plastic-based materials including, for example, polypropylene (PP) or the like. The body 210 can include an opening 211 formed therethrough. The opening 211 can be disposed in the body 210 such that the opening 211 is in fluid communication with the interior of the container 100, allowing a fluid disposed inside the container 100 to exit the container 100 via the opening 211 (e.g., as a user drinks through the lid). In some embodiments, the opening 211 can be formed at a location offset from a center of the body 210, as shown in FIG. 2A.

The body 210 can further include a thread pattern 212 formed thereon for reversibly mating the lid 200 to the container 100. The thread pattern 212 can be disposed on an internal surface of the body 210, as shown in FIG. 2A, so as to engage with a corresponding thread pattern disposed on an external surface of the container 100. Alternatively, the thread pattern 212 can be formed on an external surface of the body 210 so as to engage with a corresponding thread pattern disposed on an internal surface of the container 100.

Figure 4B:
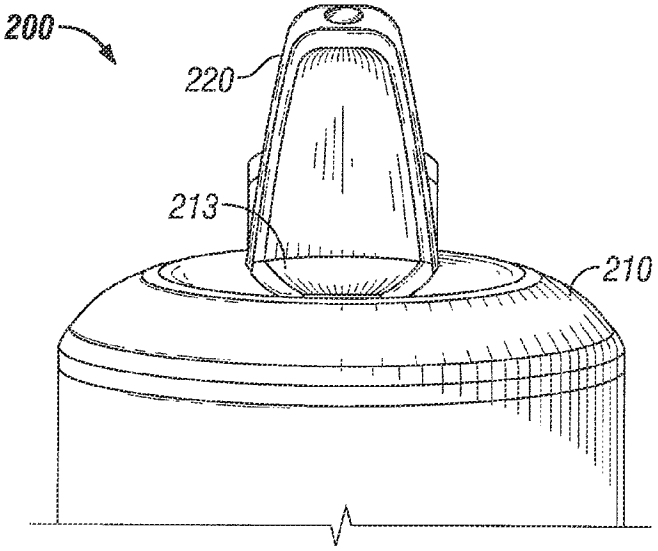
FIGS. 4A and 4B include a side cross-sectional view and a front view, respectively, of the lid of FIG. 3.
Figure 4A:
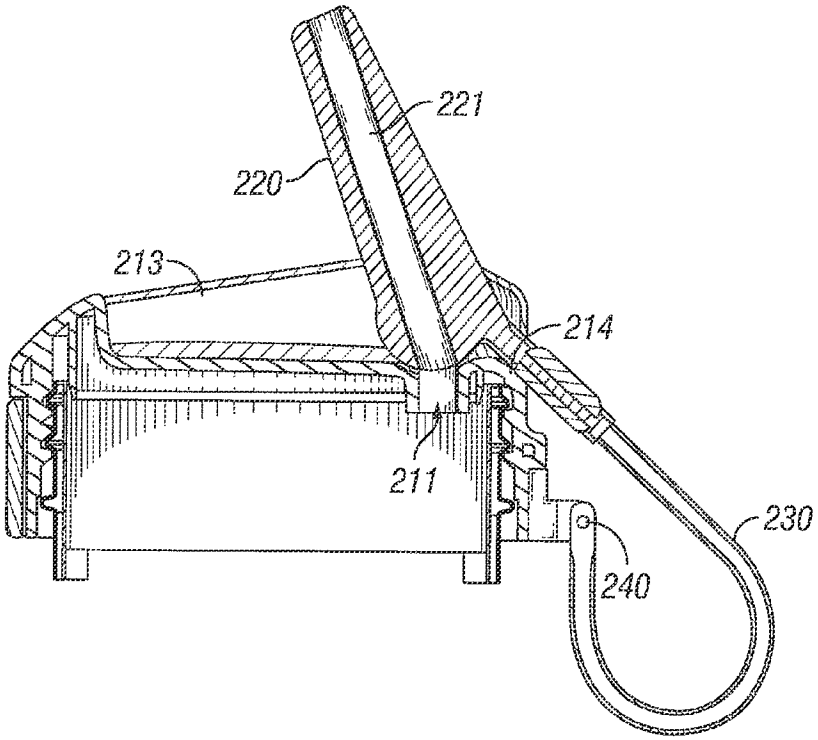

In addition, the body 210 can include an indentation portion 213 formed into an upper surface of the body 210. In some embodiments, as shown in FIGS. 4A and 4B, the indentation portion 213 can be formed along a center line of the upper surface of the body 210. The lower surface of the indentation portion 213 can be substantially parallel with the base of the container 100, or can be formed with a sloped surface, that is angularly offset from the base of the container 100, as shown in FIG. 4A. Also, in some embodiments, the opening 211 can be disposed inside of the indentation portion 213 at a bottom portion thereof.

The lid 200 can additionally include a sipping member 220 rotatably coupled to the body 210. Like the body 210, the sipping member 220 can be formed of various materials, such as plastic-based materials including, for example, PP or the like. A passageway 221 can be formed through an interior of the sipping member 220 so as to extend from a proximal end of the sipping member 220 to a distal end of the sipping member 220. For the purpose of the present disclosure, the proximal end of the sipping member 220 can correspond to the end of the sipping member 220 configured to come into contact with the opening 211 of the body 210. The distal end, by contrast, can correspond to the opposite end of the sipping member 220 engaged by a user while drinking through the sipping member 220.

The indentation portion 213 of the body 210 can define an interior receiving space configured to receive at least a portion of the sipping member 220. Particularly, when the sipping member 220 is disposed in a stowed position against the body 210 of the lid 200, as shown in FIGS. 1 and 2A-2B, the sipping member 220 can at least partially fit inside of the receiving space of the indentation portion 213 such that an upper surface of the sipping member 220 is substantially flush with an upper surface of the body 210. As a result, the sipping member 220 can be stowed conveniently against the body 210 when not in use (e.g., during transport of the container 100).

The indentation portion 213 can be formed with space enabling a portion of the sipping member 220 to rotate inside of the indentation portion 213. In this regard, the sipping member 220 can be coupled to the body 210 via support arms 222 extending outwardly from opposite sides of the sipping member 220, respectively, and attaching to the body 210, as shown in FIG. 2B. The indentation portion 213 can define support arm receiving spaces configured to receive the support arms 222. The support arm receiving spaces of the indentation portion 213 can permit the support arms to rotate therewithin. As a result, the sipping member 220 can rotate about the support arms 222. In some embodiments, the support arms 222 can be integral with the sipping member 220. That is, the sipping member 220 and the support arms 222 can be made of the same material so as to form a singular structure.

The lid 200 can further include a handle 230 for use when the user wishes to carry the container. The handle 230 can be formed of various flexible materials, such as, for example, a silicon-based material, a thermoplastic rubber-based material, or the like. The flexibility of the handle 230 can permit the handle 230 to be deformed in various shapes, as described below.

The handle 230 can be connected at a first end thereof to the sipping member 220 and rotatably coupled at a second end thereof to the body 210 via a pivot pin 240. When the lid 200 is oriented in an upright manner, as shown in FIGS. 2A and 4A, the first end of the handle 230 connected to the sipping member 220 can be positioned above the second end of the handle 230 coupled to the to the body 210 via the pivot pin 240. The handle 230 can extend outwardly from the lid 200 so as to form a carrying space inside of the handle 230 through which the user can insert one or more fingers for carrying the lid 200 and container 100 (when the container 100 and lid 200 are mated together).

In some embodiments, the first end of the handle 230 can be co-injected with a portion of the sipping member 220. That is, the respective materials of the sipping member 220 and handle 230 can be formed through injection into the same mold such that the sipping member 220 and handle 230 are attached to each other. The portion of the sipping member 220 with which the handle 230 is co-injected can correspond to an outwardly extending arm 223 disposed at or proximate to the proximal end of the sipping member 220, as shown in FIGS. 2A and 4A.

In some embodiments, the handle 230 can include a protrusion portion 231 disposed at the first end thereof, adjacent to the sipping member 220. The protrusion portion 231 can be formed with a surface level raised above that of an adjacent portion of the handle 230.

The protrusion portion 231 can further be formed with a textured upper surface, enhancing the user's ability to grip the upper portion of the handle 230. Furthermore, as a result of the co-injection, the upper surface of the protrusion portion 231 can be surrounded entirely by a portion of the sipping member 220, as shown in FIG. 2B, thus enhancing the visibility of the protrusion portion 231.

The handle 230 and the sipping member 220 can be coupled together in such a manner that certain user interaction with the handle 230 causes rotation of the sipping member 220. In this regard, the sipping member 220 can be configured to rotate between, at least, a stowed position and a released position. Of course, the sipping member 220 can freely rotate to any position between the stowed position and the released position.

As shown in FIG. 2A, when the sipping member 220 is in the stowed position, the passageway 221 of the sipping member 220 and the opening 211 of the body 210 can be misaligned, such that the opening 211 is sealed, preventing spillage of fluid contained within the container 100. In the stowed position, a portion of the body of the sipping member 220 can seal the opening 211 of the body 210. The proximal end of the sipping member 220 can be circularly shaped so as to enable rotation of the sipping member inside of the indentation portion 213, as shown in FIG. 2A. Various portions of the circularly shaped proximal end of the sipping member 220 can operate to seal the opening 211. As such, the top of the opening 211 can be shaped in a manner corresponding to the shape of the circularly shaped proximal end of the sipping member 220, allowing the top of the opening 211 to come into contact with the sipping member 220 as it rotates.

As shown in FIG. 4A, when the sipping member 220 is in the released position, the passageway 221 of the sipping member 220 and the opening 211 can be aligned, allowing a user to drink therethrough. In the released position, the passageway 221 and the opening 211 can define a fluid path through which a fluid disposed in the interior of the container 100 can exit the container 100. By contrast, the fluid path defined by the passageway 221 and the opening 211 can be obstructed by the body of the sipping member 220 in the stowed position, preventing said fluid from leaking through the lid 200.

The body 210 of the lid 200 can include a stopping portion 214 configured to prevent the sipping member 220 from rotating beyond the released position, that is, rotating further in a direction opposite of the stowed position. In this regard, a portion of the sipping member 220 and/or a portion of the handle 230 can come into contact with an outer surface, i.e., stopping portion 214, of the body 210 when the sipping member 220 rotates into the released position. The stopping portion 214 can stop the sipping member 220 from rotating beyond such position.

As noted above, manipulation of the handle 230 can cause rotation of the sipping member 220 attached thereto. In this regard, the handle 230 can be configured such that a substantially downward force exerted on the handle 230 causes rotation of the sipping member 220 toward the released position (see, e.g., FIGS. 3, 4A and 4B). A user can apply a substantially downward force on the handle 230 by, for example, pressing downwardly on an upper region of the handle 230. The user can release the sipping member 220 from the stowed position by pressing down on the protrusion portion 231, as an example.

Additionally, the user can rotate the sipping member 220 by pushing, pulling, or otherwise interacting with the handle 230 in a manner which generates a substantially downward force upon the handle 230. Thus, the user can conveniently release the sipping member 220 from the stowed position through a substantially downwardly directed interaction with the handle 230.

In addition to rotation of the sipping member 220, the substantially downward force exerted on the handle 230 described above can also cause rotation of the handle 230 about the pivot pin 240. In one example, rotation of the sipping member 220 from the stowed position to the released position can cause the handle 230 to rotate about the pivot pin 240 approximately 90 degrees. Rotation of the sipping member 220 from the released position to the stowed position can cause the handle 230 to rotate about the pivot pin 240 approximately 90 degrees in the opposite direction.

As mentioned above, the handle 230 in conjunction with an outer portion of the body 210 can define a carrying space therein through which the user can insert one or more fingers for carrying the lid 200. In some cases, the size and shape of the carrying space defined inside of the handle 230 can be modified due to the flexibility of the handle 230, such as in response to rotation of the sipping member 220 and handle 230. For example, when the sipping member 220 is rotated from the released position to the stowed position, the size of the carrying space as defined by the handle 230 and the outer portion of the body 210 can increase, as demonstrated in FIG. 1 in relation to FIG. 3. Conversely, when the sipping member 220 is rotated from the stowed position to the released position, the size of the carrying space can decrease as the handle 230 flexes in response to such rotation.

Meanwhile, a substantially upward or lateral (i.e., sideways) force can be exerted on the handle 230 when the user is carrying the lid 200 by the handle 230, e.g., during transport of the container 100. In such case, the handle 230 can be configured such that, when the sipping member 220 is in the stowed position, as shown in FIGS. 1, 2A and 2B, the sipping member 220 can remain stowed in response to the substantially upward or lateral force exerted on the handle 230. Therefore, the lid 200 and container 100 can be carried by the handle 230, while the sipping member 220 is stowed, without inadvertent release of the sipping member 220.

Accordingly, the container lid with a rotatable sipping member ("sipper") and flexible handle disclosed herein enables a user to stow the sipper when its presence is unnecessary or unwanted. A simple substantially downward force exerted on the handle can cause release (rotation) of the sipper away from the stowed position, allowing a user to drink through the sipper. However, when the sipper is stowed away, a user can carry the lid by the handle without the sipper releasing.

The foregoing description has been directed to embodiments of the present disclosure. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A container lid, comprising:

a body having an upper surface and a sidewall;

one or more threads disposed on an inner surface of said sidewall, said one or more threads configured to connect the body to a container;

an indentation formed in said body, an opening disposed in said indentation;

a sipping member rotatably connected to said body and movable between stowed position and a released position, said sipping member having a passageway therethrough, wherein said passageway is sealed from flow communication with said opening in said stowed position and unsealed for fluid communication with said opening in said released position;

a handle having a first end and a second end, said first end connected to said sipping member at said first end and rotatably connected to said body at said second end, said handle having a curvature and being formed of a flexible material wherein said handle allows movement of said sipping member between said stowed position and said released position;

wherein upon application of a pushing force on the handle, a vertical distance between said first end and said second end of said handle changes and a radius of said curvature of the handle reduces when actuating said handle and said sipping member between said stowed position and said released position.

2. The container lid of claim 1, further comprising said container to which said body connected.

3. The container lid of claim 1, wherein said handle places a biasing force on said sipping member when in said stowed position to maintain said sipping member in said stowed position.

4. The container lid of claim 1, said opening and said passageway defining a fluid flow path which is obstructed in the stowed position.

5. The container lid of claim 4, said fluid flow path being unobstructed in said released position.

6. The container lid of claim 1, wherein said handle is capable of receiving a downforce to move said sipping member from said stowed position to said released position.

7. The container lid of claim 6, said handle further comprising a protrusion on said upper surface for receiving said downforce.

8. The container lid of claim 1 further comprising a pin connection at said second end of said handle between said body and said handle.

9. The container lid of claim 1, said handle being curved between said first end and said second end.

10. The container lid of claim 1, said upper surface of said body being flat or angled.

11. The container lid of claim 10, a portion of said sipping member defining a portion of said upper surface.

12. A container lid, comprising:

a body having a sidewall which is circular in shape, said sidewall having an inner surface which has one or more threads;

an upper surface of said body having an indentation, said indentation having an opening therein;

a sipping member which is received by said indentation, said sipping member movable between a stowed position within said indentation and a released position, said sipping member having a passageway therein;

wherein said passageway and said opening are aligned for fluid flow in said released position and unaligned to block fluid flow in said stowed position;

a curved handle formed of a flexible material extending between said sipping member and said sidewall of said body, wherein said curved handle is pivotally connected to said sidewall, said curved handle having a first radius when said sipping member is in said stowed position and second smaller radius when said sipping member is in said released position;

wherein said curved handle biases said sipping member to said stowed position, and said may be pressed to change said curved handle from said first radius to said second smaller radius and move said sipping member from said stowed position to said released position.

13. The container lid of claim 12, said sipping member being substantially flush with said upper surface of said body when said sipping member is disposed in said stowed position.

14. The container lid of claim 13, said sipping member being formed of a polypropylene-based material and said curved handle being formed of a silicon-based material or a thermoplastic rubber material.

* * * * *